US006412634B1

(12) United States Patent
Telesca et al.

(10) Patent No.: US 6,412,634 B1
(45) Date of Patent: Jul. 2, 2002

(54) REFILLABLE TOWELETTE DISPENSING ARTICLE

(75) Inventors: Josephine Telesca, Trumbull; Raymond Michael Flaig, Stamford, both of CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 9 days.

(21) Appl. No.: 09/714,642

(22) Filed: Nov. 16, 2000

Related U.S. Application Data

(60) Provisional application No. 60/200,802, filed on May 1, 2000.

(51) Int. Cl.[7] ..... B65D 73/00

(52) U.S. Cl. ..... 206/494; 220/254.5; 220/259.1; 220/833

(58) Field of Search ..... 206/494, 581, 206/823, 210; 220/810, 833, 836, 254.3, 254.5, 259.1

(56) References Cited

U.S. PATENT DOCUMENTS

| | | | | |
|---|---|---|---|---|
| D83,026 | S | 1/1931 | Andrews | |
| 3,441,071 | A | 4/1969 | Schurman et al. | |
| 3,784,055 | A | 1/1974 | Anderson | |
| 3,967,756 | A | 7/1976 | Barish | |
| D279,258 | S | 6/1985 | Curtis | |
| 4,535,912 | A | 8/1985 | Bonk | |
| 4,553,665 | A | * 11/1985 | Weick et al. | 206/494 |
| 4,790,436 | A | 12/1988 | Nakamura | |
| 4,915,268 | A | 4/1990 | Lay et al. | |
| D320,743 | S | 10/1991 | Alexander et al. | |
| D336,612 | S | 6/1993 | Miller et al. | |
| 5,358,140 | A | * 10/1994 | Pellegrino | 206/494 |
| 5,379,897 | A | 1/1995 | Muckenfuhs et al. | |
| 5,531,325 | A | 7/1996 | Deflander et al. | |
| 5,647,506 | A | 7/1997 | Julius | |
| 5,699,912 | A | 12/1997 | Ishakawa et al. | |
| 5,730,310 | A | 3/1998 | Yoshihara | |
| D401,017 | S | 11/1998 | Thorpe | |
| D411,040 | S | 6/1999 | Gilbertson et al. | |
| 6,006,937 | A | * 12/1999 | Baravagito et al. | 206/823 |
| 6,047,710 | A | * 4/2000 | Irving et al. | 206/581 |
| 6,092,690 | A | * 7/2000 | Bitowft et al. | 206/494 |
| 6,102,247 | A | 8/2000 | Crawford | |
| 6,173,719 | B1 | * 1/2001 | Petit | 206/581 |
| 6,199,559 | B1 | * 3/2001 | Nikolaus et al. | 206/581 |

FOREIGN PATENT DOCUMENTS

| | | |
|---|---|---|
| DE | 297 05 720 | 4/1997 |

OTHER PUBLICATIONS

Photocopy of Kao Biore carton—1999.
Photocopy of Silcott carton—1999.

* cited by examiner

*Primary Examiner*—Luan K. Bui
(74) *Attorney, Agent, or Firm*—Milton L. Honig

(57) ABSTRACT

A dispensing article, particularly for dispensing towelettes, is provided and includes a container body for storing the towelettes and a lid hingedly attached to the body. The container is formed from a floor panel, left and right side panels, front and rear panels and a deck panel. The deck panel includes a sealing section with a dispensing aperture. The sealing section is domed outwardly away from the floor. A downwardly projecting plug on an interior surface of the lid, in a closed position, engages within the dispensing aperture forming a seal therewith. The domed nature of the sealing section improves the air tight closure and shortens the required length of the plug to minimize aesthetically displeasing sink marks in the plastic wall of the plug.

12 Claims, 3 Drawing Sheets

REFILLABLE TOWELETTE DISPENSING ARTICLE

This application claims the benefit of U.S. Provisional Application Serial No. 60/200,802, filed May 1, 2000.

BACKGROUND OF THE INVENTION

1. Field of the Invention

The invention concerns a towelette dispensing container adapted for refill.

2. The Related Art

Chemically impregnated pads, sheets and tissues (collectively defined as towelettes) are established articles of commerce. They are generally utilized for personal hygiene, cosmetic purposes and household cleaning applications. Fluid impregnated wipes require packaging which avoids evaporation of solvents. Dry towelettes impregnated with dry chemical coatings (e.g. surfactant compositions) require exclusion of atmospheric moisture during storage periods. Problems arise where a stack of impregnated towelettes are packed together in a common container. Dispensing of a single item requires resealability of the container to prevent the items from either drying out or absorbing unwanted moisture. Notable advances in the art include the following disclosures.

U.S. Pat. No. 5,647,506 (Julius) describes a resealable dispenser for delivering interleaved, individual moisture-impregnated tissues from a housing having sufficient rigidity to retain its shape subsequent to its manufacture. A top wall includes a recess portion provided with an orifice for removing individual tissues from the housing.

U.S. Pat. No. 5,379,897 (Muckenfuhs et al.) discloses a disposable, compactable package for delivering a stack of tissues. The package may be produced as a thermoform. A tabbed resealable label is secured over a bottom area of the package.

U.S. Pat. No. 4,790,436 (Nakamura) discloses a resealable dispenser-container for wet tissues. A deformable pouch containing a stack of the tissues is held rigid with the assistance of a shape maintaining member even after most of the tissues have been dispensed. Suitable shape maintaining members include an outer box surrounding the pouch fixed with an adhesive on an undersurface of the box roof which prevents pouch wall collapse. A second embodiment is a U-shaped frame inserted within the pouch.

U.S. Pat. No. 5,531,325 (Deflander et al.) describes a pouch for storing interleaved tissues with a resealable flap opening. The pouch is housed in a rigid outer container which in its closed position is sufficiently air-tight to prevent exchange of air between contents of the container and the outside atmosphere. An anti-slip member such as a glue strip is attached to the pouch and projects through a hole in the bottom of the container to prevent the latter from slipping on a support surface.

Commercial expressions of towelette packaging art include a Kao Biore® dispenser of fluid impregnated tissues. An outer relatively rigid case surrounds a relatively soft refill pack of tissues within a flexible foil package. The outer case has a cover portion with top and side walls while a bottom wall is sealably/replaceably snapped onto the underside of the cover. An aperture for dispensing towelettes and hinged lid is constructed in the top wall of the upper cover. Evaporation of moisture requires a tight seal between side walls and bottom wall as well as a sufficient friction seal of the lid against the aperture. It is not always easy to ensure that both types of seals are sufficiently tight. Most especially, the floor wall because of its relatively large sealing perimeter requires great care in closure with the bottom edge of the side walls.

A related package with similar structural problems is also commercially in the Japanese market sold under the Silcot trademark.

Evident from the foregoing selection of technology is the need for improved, more efficient mechanisms for ensuring good seals to prevent moisture or solvents from transferring in either direction through the seals.

Accordingly, it is an object of the present invention to provide a towelette dispenser which can maintain a stack of towelettes hermetically sealed from the atmosphere during extended storage periods, especially after multiple openings for dispensing of individual tissues.

It is a further object of the present invention to provide a towelette product with a reusable outer container which after having dispensed most of a stack of towelettes is substantially as efficiently resealable as in its initial fully towelette filled position.

SUMMARY OF THE INVENTION

A dispensing article, particularly for towelettes, is provided which includes:

a container body having a floor panel, left and right side panels opposite one another rising from the floor panel, front and rear panels opposite one another rising from the floor panel and deck panel opposite the floor panel, the deck panel including a sealing section, a dispensing aperture formed in the sealing section, and wherein the sealing section is domed outwardly away from the floor panel; and a lid hingedly attached to the body, the lid in a closed position overlying the sealing section.

Further, the invention provides a towelette product which includes:

a stack of flexible towelettes; and a container body receiving the towelettes and having a floor panel, left and right side panels opposite one another rising from the floor panel, front and rear panels opposite one another rising from the floor panel and a deck panel opposite the floor panel, the deck panel including a sealing section, a dispensing aperture formed in the sealing section, and wherein the sealing section is domed outwardly away from the floor panel; and a lid hingedly attached to the body, the lid in a closed position overlying the sealing section.

The deck panel is further defined by left and right shoulder sections flanking the sealing section. Upper surfaces of the shoulder sections are landings raised above an upper surface of the sealing section. The lid in the closed position deploys form fittingly between the left and right shoulder sections.

A plug projects downwardly from an interior surface of the lid. When the lid is in the closed position, the plug overlies the dispensing aperture forming a seal therewith.

A rim pocket is formed along a perimeter on an under surface of the deck panel. A complementary rim finger is fashioned along top edges of the left, right, front and rear panels. The rim pocket and finger are reversibly engageable. Refill stacks of towelettes can be loaded into the container body when the deck panel is removed. Subsequent to refill, the deck panel can be reattached by sealing engagement of the rim pocket and finger.

Advantageously at least one of the panels, but preferably all the panels of the container are sufficiently translucent to allow viewing of the towelette stack. In this manner, it can be determined whether a refill is soon to be required.

BRIEF DESCRIPTION OF THE DRAWING

Further objects, features and advantages of the present invention will become more evident from consideration of the following drawing in which.

DETAILED DESCRIPTION OF THE INVENTION

Now it has been found that a refillable towelette dispenser can be provided with a more effective seal arrangement. Vapor transfer is controllable to a high degree by the improved configuration. A section of a deck panel containing the towelette dispensing aperture is formed as a domed upwardly bowed area. The dome provides two advantages. Firstly, the dome allows for a better seal than obtainable with a flat configuration. Secondly, the dome permits use of a shorter length plug. Less sink marks from the plastic extrusion process occur with the shorter plug thereby increasing aesthetic appeal.

Figure 1:
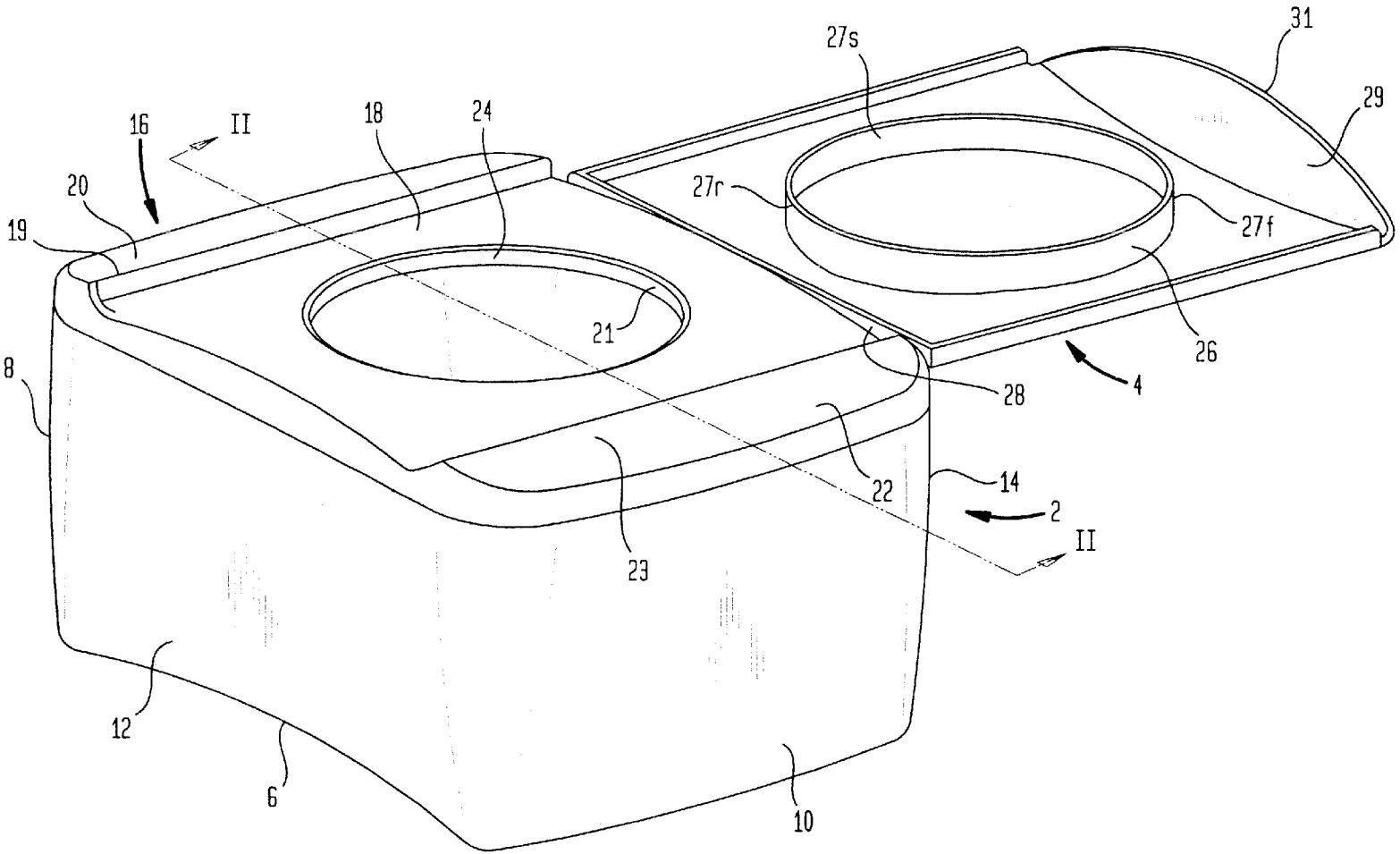
FIG. 1 is a plan perspective view of the dispensing article according to the present invention.

FIG. 1 illustrates the dispensing article which includes a container body 2 and a lid 4 hingedly attached to the body. The container body has a floor panel 6, left side panel 8, right side panel 10, front panel 12 and rear panel 14. The left and right side panels are opposite one another and rise from the floor panel. Likewise, front and rear panels are opposite one another also rising from the floor panel. A deck panel 16 is opposite the floor and intersects the left, right and side panels. The deck panel includes a sealing section 18 flanked respectively by left and right shoulder sections 20, 22. The sealing section is domed outwardly away from the floor panel.

Upper surfaces of the shoulder sections in the form of landings 19, 23 are raised above an upper surface of the seating section. In a closed position, the lid deploys form fittingly between the landings and covers a dispensing aperture 24 formed in the sealing section. Lid 4 on an interior surface is provided with a plug 26 projecting downwardly toward the floor panel. Plug 26 is of circular construction with a diameter slightly smaller than that of the dispensing aperture. The plug has a non-uniform depth to accommodate the domed topography of the sealing section. Sections 27F and 27R of plug 26 are of greater depth being positioned along highest (front and rear) areas of the dome. Sections 27S of plug 26 are of lesser depth being positioned along lowest (side) areas of the dome. A downwardly projecting circular engagement lip 21 defines the dispensing aperture 24. Areas of lip 21 are of non-uniform depth complementary to the depths of sections 27 of plug 26. In a closed position, the lid through hinge 28 overlies the sealing section with the plug snugly engageable within the aperture ensuring an air tight seal. Tab 29 is fashioned along an outer edge of the lid orthogonal to the under surface protruding away in a direction of the plug. The tab has a leading hemicircular edge 31 engageable against the front panel of the container body.

Figure 4:
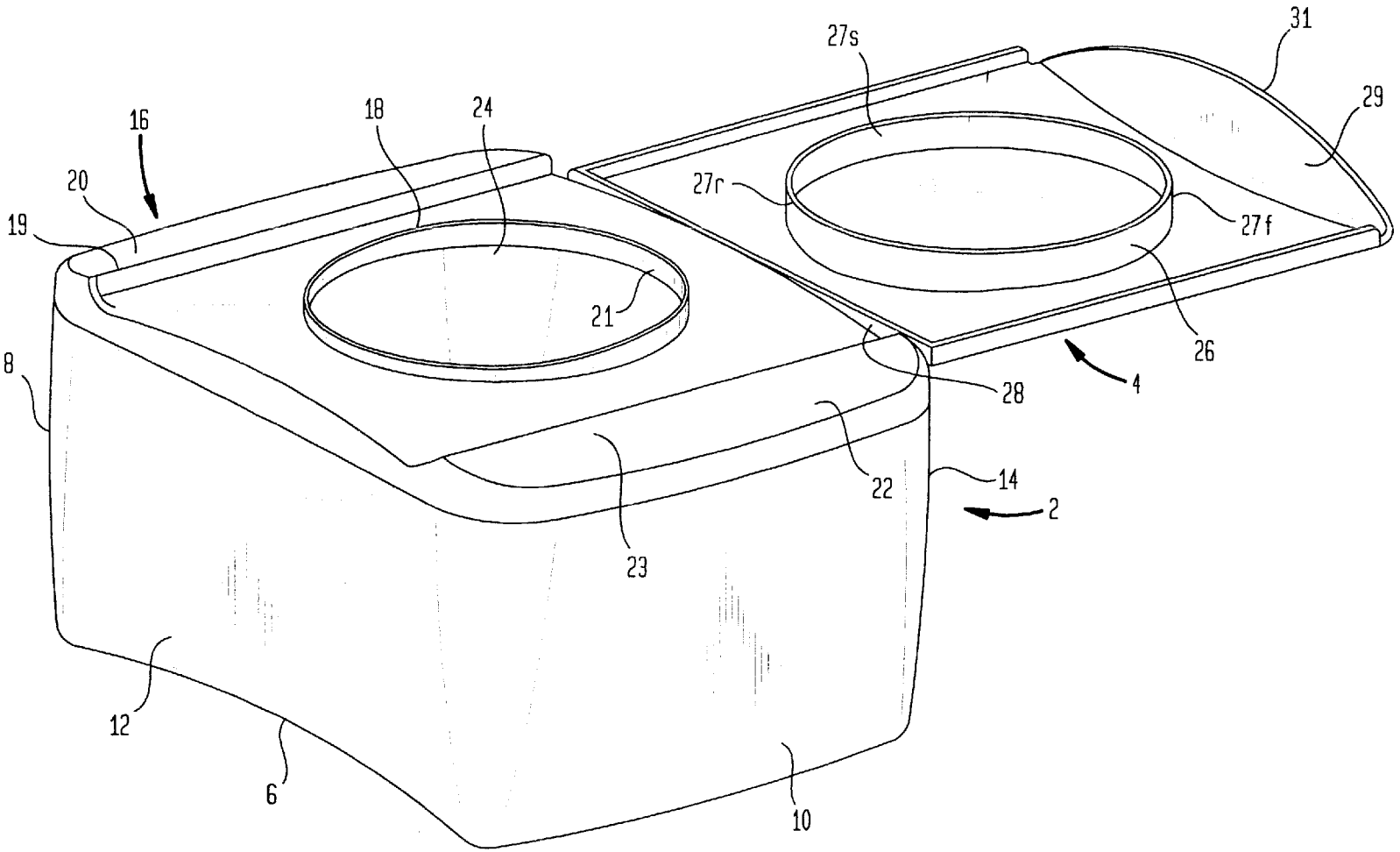
FIG. 4 is a plan perspective view of a second embodiment of the dispensing article.

It is possible to additionally include a complementary plug projecting upwardly from the sealing section and circumscribing the dispensing aperture. FIG. 4 illustrates this embodiment. Herein a plug 34 projects upwardly from the sealing section 18 to circumscribe the dispensing aperture 24. In a closed position of the lid, both sets of plugs will engage one another to improve seal properties.

Figure 2:
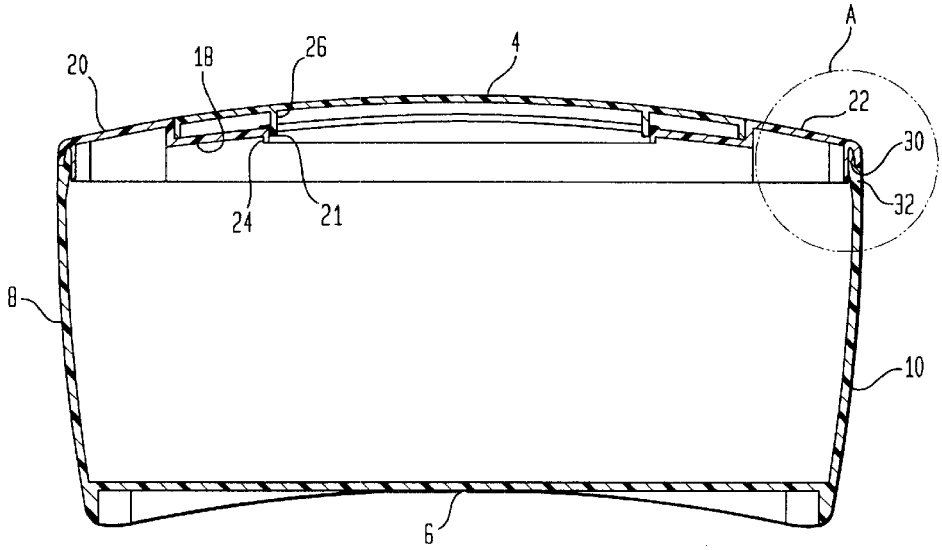
FIG. 2 is a cross-sectional view along line II—II of FIG. 1.
Figure 3:
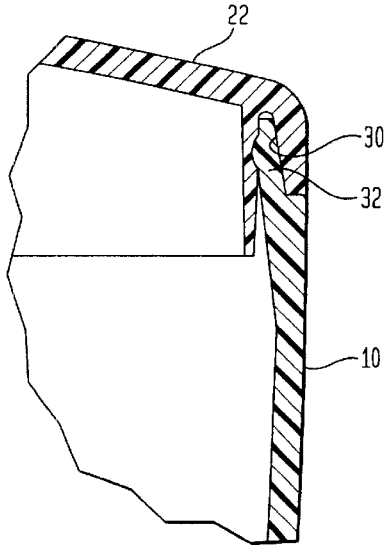
FIG. 3 is a cross-section magnified partial view of area A of FIG. 2 revealing the sealing engagement of the rims.

A rim pocket 30 is formed along a perimeter on an under surface of the deck panel. A complementary rim finger 32 is fashioned along top edges of the left, right, front and rear panels. The rim pocket and finger are reversibly engageable with one another to form a seal in an engaged position. FIGS. 2 and 3 best illustrate the friction fit arrangement between the deck and other panels.

The deck panel 16 is separable from the container body 6 through disengagement of rim finger and pocket. In the disengaged positions, the container body can be restocked with towelettes or similar dispensable articles. Thereafter the deck panel can be replaced over the container body with all seals being re-established.

The foregoing description illustrates selected embodiments of the present invention. In light thereof, various modifications would be suggested to one skilled in the art, all of which are within the spirit and purview of this invention.

What is claimed is:

1. A dispensing article comprising:

a container body having a floor panel, left and right side panels opposite one another rising from the floor panel, front and rear panels opposite one another rising from the floor panel and a deck panel opposite the floor panel, the deck panel including a sealing section a dispensing aperture formed in the sealing section, and wherein the sealing section is domed outwardly away from the floor panel; and a lid hingedly attached to the body, the lid in a closed position overlying the sealing section, a plug projecting downwardly from an interior surface of the lid and having a non-uniform depth, the plug being engageable with the dispensing aperture in the closed position of the lid.

2. The article according to claim 1 wherein the deck panel further comprises left and right shoulder sections flanking the sealing section, upper surfaces of the shoulder sections being landings raised above an upper surface of the sealing section.

3. The article according to claim 2 wherein the lid in the closed position deploys form fittingly between the left and right shoulder sections.

4. The article according to claim 1 further comprising a rim pocket along a perimeter of an under surface of the deck panel and a complementary rim finger along top edges of the left, right, front and rear panels, the rim pocket and finger being reversibly engageable and forming a seal in an engaged position.

5. The article according to claim 1 wherein at least one of the panels is at least sufficient translucent to allow viewing of items held within the container body.

6. The article according to claim 1 wherein the plug depth is greater along front and rear areas of the dome.

7. The article according to claim 1 wherein the plug depth is less along side areas of the dome.

8. The article according to claim 1 wherein the dispensing aperture is defined by a downwardly projecting circular engagement lip.

9. The article according to claim 8 wherein the engagement lip has a non-uniform depth.

10. The article according to claim 9 wherein the non-uniform depth of the lip is complementary to the non-uniform depth of the plug.

11. A towelette product comprising:

a stack of towelettes; and a container body receiving the towelettes and having a floor panel, left and right side panels opposite one another rising from the floor panel, front and rear panels opposite one another rising from the floor panel and a deck panel opposite the floor panel, the deck panel including a sealing section, a dispensing aperture formed in the sealing section, and wherein the sealing section is domed outwardly away from the floor panel; and a lid hingedly attached to the body, the lid in a closed position overlying the sealing section, a plug projecting downwardly from an interior surface of the lid and having a non-uniform depth, the plug being engageable with the dispensing aperture in the closed position of the lid.

12. A dispensing article comprising:

a container body having a floor panel, left and right side panels opposite one another rising from the floor panel, front and rear panels opposite one another rising from the floor panel and a deck panel opposite the floor panel, the deck panel including a sealing section a dispensing aperture formed in the sealing section, and wherein the sealing section is domed outwardly away from the floor panel, and a plug projecting upwardly from the sealing section and circumscribing the dispensing aperture, the plug having a non-uniform depth; and a lid hingedly attached to the body, the lid in a closed position overlying the sealing section.

* * * * *